United States Patent [19]

Nishioka et al.

[11] Patent Number: 4,950,334

[45] Date of Patent: Aug. 21, 1990

[54] GAS CARBURIZING METHOD AND APPARATUS

[75] Inventors: Nobuo Nishioka; Tadayoshi Juge, both of Kyoto; Yoshiaki Shimizu, Kameoka; Keishichi Namba; Hiroshi Shimura, both of Yokohama; Fumitaka Abukawa; Hitoshi Goi, both of Yokohama; Kazuyoshi Fujita; Yuichi Takasu, both of Yokohama, all of Japan

[73] Assignees: Mitsubishi Jidosha Kogyo Kabushiki Kaisha, Tokyo; Tokyo Heat Treating Company, Ltd., Kanagawa, both of Japan

[21] Appl. No.: 183,758

[22] PCT Filed: Aug. 12, 1987

[86] PCT No.: PCT/JP87/00605

§ 371 Date: Apr. 11, 1988

§ 102(e) Date: Apr. 11, 1988

[30] Foreign Application Priority Data

Aug. 12, 1986 [JP] Japan ..... 61-189014
Aug. 12, 1986 [JP] Japan ..... 61-189015

[51] Int. Cl.[5] ..... F27B 9/40; C21D 9/00; C21D 1/00

[52] U.S. Cl. ..... 148/16.5; 266/251

[58] Field of Search ..... 148/16.5; 266/251

[56] References Cited

U.S. PATENT DOCUMENTS 3,843,419 10/1974 Schmidt et al. ..... 266/251
4,108,693 8/1978 L'Hermite et al. ..... 148/16.5
4,145,232 3/1979 Solomon ..... 148/16.5
4,306,918 12/1981 Kaspersma et al. ..... 148/16.5
4,457,493 7/1984 Takahashi ..... 266/257
4,472,209 9/1984 Längerich et al. ..... 148/16.5
4,744,839 5/1988 Queille ..... 148/16.5

FOREIGN PATENT DOCUMENTS 50-113426 8/1975 Japan .
59-70769 2/1984 Japan .
61-27485 4/1986 Japan .

*Primary Examiner*—Upendra Roy
*Attorney, Agent, or Firm*—Hedman, Gibson, Costigan & Hoare

[57] ABSTRACT

In a gas carburizing method, a hydrocarbon gas and air are supplied to a furnace main body that carburizes a workpiece. The hydrocarbon gas and air react with one another in the furnace main body to generate an atmospheric gas having a carburizing property. The flow rate of the hydrocarbon gas to be supplied is maintained at a predetermined value. The flow rate of air to be supplied can be altered by adjusting the carbon potential of the atmospheric gas.

A gas carburizing apparatus includes a furnace main body and load and unload chambers provided on two ends of the furnace main body. The load and unload chambers have combustion units. The combustion units communicate with the interiors of the load and unload chambers and burn a hydrocarbon gas. The combustion gas of the hydrocarbon gas is supplied to the load and unload chambers.

5 Claims, 3 Drawing Sheets

GAS CARBURIZING METHOD AND APPARATUS

TECHNICAL FIELD

The present invention relates to a gas carburizing method for carburizing a workpiece by heating it in a furnace main body filled with an atmosphere gas having a carburizing property, and an apparatus used for practicing the same.

BACKGROUND ART

A gas carburizing method is available as one of the methods, i.e., carburizing methods, used for hardening only the surface layer of a steel product by diffusing carbon in the surface layer of the steel product. A conventional apparatus for practicing the gas carburizing method has a main furnace and a conversion furnace. An atmospheric gas having a carburizing property is sent to the main furnace until it is filled. A steel product, i.e., a workpiece is heated in the main furnace and is thus carburized. The conversion furnace generates a carrier gas, e.g., an endothermic conversion gas (to be referred to as an RX gas hereinafter). A carburizing gas, e.g., a hydrocarbon gas (a propane or city gas), is added to the generated carrier gas to increase its carburizing property, and the resultant gas mixture is supplied to the main furnace. The carbon potential of the atmosphere gas to be supplied to the main furnace is adjusted by adjusting the adding amount of the hydrocarbon gas.

However, the conventional method and apparatus described above require a conversion furnace in addition to a main furnace. Therefore, a heat energy is needed for the conversion furnace resulting in increase in the cost. Since a heater, a retort and the like used in the conversion furnace are expendable supplies, their maintenance is costly. Since the conversion furnace requires an expensive catalyst to effectively generate the RX gas, the cost is further increased.

Since the RX gas contains a component which is unstable at high temperatures, it is rapidly cooled in the exit of the conversion furnace so that the composition of the RX gas may not be changed. Therefore, a cooled RX gas is supplied to the main furnace and energy loss in the main furnace becomes undesirably large.

In the conventional method, the carbon potential in the atmospheric gas in the main furnace is adjusted by adjusting the amount of the hydrocarbon gas added to the RX gas. However, even a little change in amount of the hydrocarbon gas to be added results in a great change in carbon potential of the atmospheric gas. Therefore, adjustment of the carbon potential of the main furnace tends to be inaccurate. Particularly, when the state of the atmospheric gas changes in a comparatively short period of time, as in a continuous gas carburizing furnace, adjustment of the carbon potential of the atmospheric gas tends to be more inaccurate. As a result, soot attaches to the surface of the workpiece which interferes with carburization and carburizing is interfered.

Load and unload chambers are provided before and after the conventional main furnace, respectively. Entrance and exit doors are provided to the load and unload chambers, respectively. Intermediate doors are provided between the load chamber and the main furnace and between the main furnace and the unload chamber. When a workpiece is to be loaded, the entrance and intermediate doors of the load chamber are alternately opened/closed. When a workpiece is to be unloaded, the intermediate and exit doors of the unload chamber are alternately opened/closed. As a result, the atmospheric gas in the main furnace is prevented from flowing to the outside. Generally, the gas temperature of the main furnace is maintained at about 900° C., and the gas temperature of the load and unload chambers is maintained at about 500° C.

When the entrance, exit, or intermediate door is opened/closed, the gas pressure in the load or unload chamber sometimes becomes negative since the gas flows out of the furnace. In this case, when external air should flow into the load or unload chamber, the high-temperature gas in the load or unload chamber is mixed with the air and may cause an explosion. In order to prevent this, conventionally, an RX gas is supplied to the load and unload chambers from the conversion furnace so that the pressure in them may not be negative. This results in a large RX gas consumption, which is an economical disadvantage.

In another conventional apparatus, an inert gas such as nitrogen is supplied to the load and unload chambers when the pressure in them becomes negative. However, this apparatus requires a separate inert gas source, e.g., a cylinder or the like containing nitrogen. As a result, the entire apparatus becomes complex and is disadvantageous in terms of economy since a large amount of inert gas is consumed. When the inert gas is supplied, the composition of the atmosphere gas in the main furnace is changed, and sometimes the quality of the workpiece is adversely influenced.

DISCLOSURE OF INVENTION

The present invention has been made in order to eliminate the above drawbacks. According to the method of the present invention, the conversion furnace described above is omitted, and a hydrocarbon gas and air are directly supplied to a main furnace that performs carburizing, thereby generating an atmospheric gas having a carburizing property in the main furnace. The supply amount of the hydrocarbon gas is maintained at a constant value but the supply amount of air is adjusted, thereby adjusting the carbon potential of the atmospheric gas. With this adjusting method, the carbon potential of the atmospheric gas becomes stable and can be correctly and easily controlled. According to the method of the present invention, since the conversion furnace can be omitted, the manufacturing cost of the facility and its running cost can be decreased.

In the apparatus according to the present invention, a hydrocarbon gas combustion unit is connected to the load or unload chamber through an air vent section. When the pressure in the furnace is decreased, a combustion gas of the hydrocarbon gas is supplied to the load or unload chamber through the combustion unit. Therefore, a separate conversion furnace is not needed, or an expensive inert gas source is not needed. Since the combustion gas of the hydrocarbon gas has a composition similar to that of the atmospheric gas in the carburizing furnace, it does not adversely affect the composition of the atmospheric gas.

BRIEF DESCRIPTION OF DRAWINGS

The present invention will become apparent through its embodiment described with reference to the following drawings in which.

BEST MODE OF CARRYING OUT THE INVENTION

Figure 1:
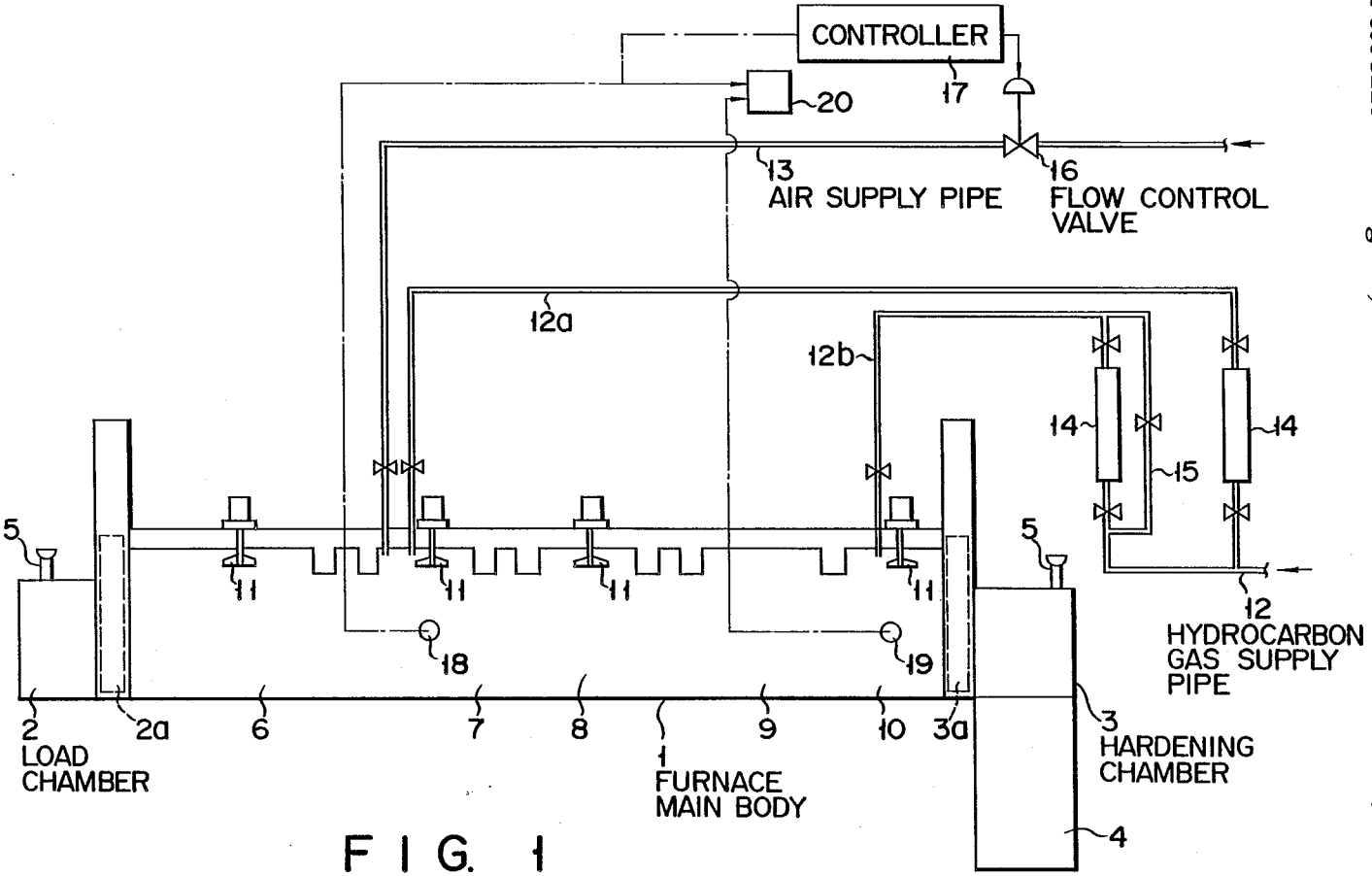
FIG. 1 is a schematic diagram showing an overall configuration of a continuous gas carburizing furnace according to the present invention.

An embodiment of the present invention will be described with reference to the accompanying drawings. FIG. 1 shows the overall configuration of a continuous gas carburizing furnace for practicing the gas carburizing method used in the present invention. The gas carburizing furnace has a furnace main body 1. Load chamber 2 is provided on the entrance side of furnace main body 1, and an unload chamber, e.g., hardening chamber 3 is provided on the exit side of furnace main body 1. Hardening oil tank 4 is provided under hardening chamber 3. Hydrocarbon gas combustion units 5 are provided above load and hardening chambers 2 and 3, respectively, through vent pipes.

Preheat section 6, first and second carburizing sections 7 and 8, diffusion section 9, and hardening chamber guide section 10 are formed in furnace main body 1 in this order from its load chamber 2 side. Intermediate door 2a which can be opened/closed is provided between preheat section 6 of furnace main body 1 and chamber 2, and intermediate door 3a which can be opened/closed is similarly provided between guide section 10 of furnace main body 1 and hardening chamber 3. When a pressure difference occurs between furnace main body 1 and load or unload chamber 2 or 3, as in the case where the entrance door (not shown) of load chamber 2, or an exit door (not shown) of hardening chamber 3 is opened, intermediate door 2a or 3a is caused to close. When the pressure in furnace main body 1 and that in load or unload chamber 2 or 3 is the same, intermediate door 2a or 3a is opened. Fans 11 are provided respectively to preheat section 6, first and second carburizing sections 7 and 8, and guide section 10 of furnace main body 1 for agitating the atmospheric gas in the furnace.

Hydrocarbon gas, supply pipe 12 and air supply pipe 13 are connected to furnace main body 1. A hydrocarbon gas (e.g., a propane or city gas) is supplied to furnace main body 1 through pipe 12, and air is supplied to furnace main body 1 through pipe 13. The hydrocarbon gas and air are mixed in furnace main body 1 and react with one another to generate an atmospheric gas having a carburizing property. Pipe 12 comprises a pair of branch pipes 12a and 12b. First branch pipe 12a communicates with first carburizing section 7. Second branch pipe 12b communicates with guide section 10. Flow meters 14 are provided midway along first and second branch pipes 12a and 12b, respectively. Pipe 12b is connected to bypass pipe 15 bypassing flow meter 14. The flow rate of the hydrocarbon gas supplied to furnace main body 1 through first and second pipes 12a and 12b is constantly kept at a predetermined value. Air supply pipe 13 communicates with first carburizing section 7 of furnace main body 1. Flow control valve 16 is provided midway along pipe 13. Valve 16 is connected to controller 17. Controller 17 is of a known type and comprises a microcomputer and a peripheral circuit.

Oxygen sensors 18 and 19 are provided in furnace main body 1. First oxygen sensor 18 is arranged in first carburizing section 7, and second oxygen sensor 19 is arranged in hardening chamber guide section 10. Sensor 18 is connected to controller 17 and recorder 20. The oxygen content in the atmospheric gas in furnace main body 1 is detected by sensor 18, and a corresponding detection signal is supplied to controller 17. Controller 17 adjusts the opening of flow control valve 16 of air supply pipe 13 in accordance with the detection signal. As a result, the rate at which the flow of air is supplied to furnace main body 1 is controlled. Sensor 19 is connected to recorder 20. Recorder 20 records the measured value of the oxygen concentration obtained by sensors 18 and 19.

Figure 2:
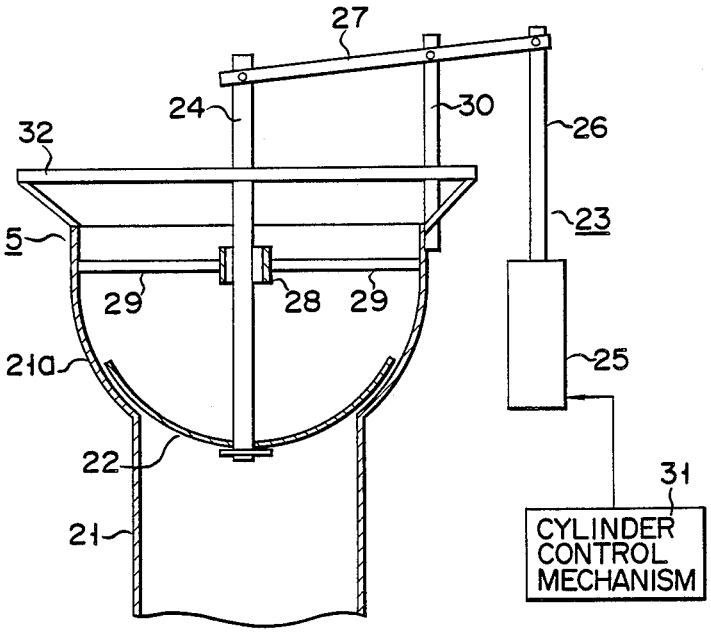
FIG. 2 is a longitudinal sectional view of a vent section and a combustion unit.
Figure 3:
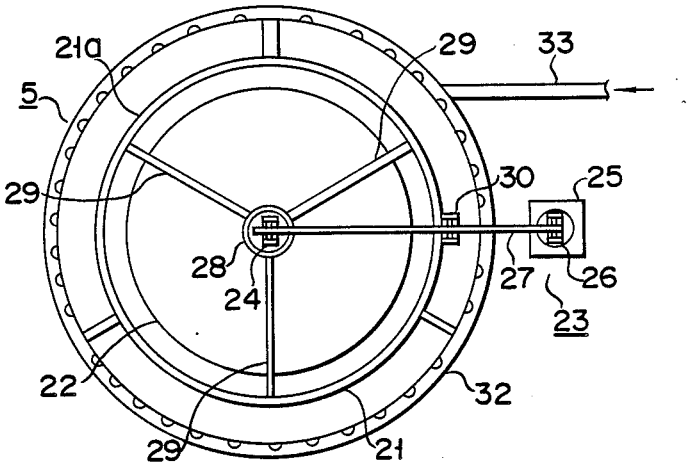
FIG. 3 is a plan view of FIG. 2.

Combustion units 5 are provided above load and hardening chambers 2 and 3, respectively. Each combustion unit 5 has an arrangement as shown in FIGS. 2 and 3. Each combustion unit 5 has a vent pipe 21. The lower ends of pipes 21 communicate with load and hardening chambers 2 and 3, respectively. Wide-open portion 21a having a large diameter is formed in the upper end of each vent pipe 21. Substantially semi-spherical vent lid 22 is provided in wide-open portion 21a. Vent lid 22 is opened/closed by vent lid opening/-closing mechanism 23. Mechanism 23 has vent lid support rod 24, drive cylinder 25, drive rod 26, and coupling arm 27. Support rod 24 is guided by guide pipe 28 to be slidable in the axial direction. Guide pipe 28 is supported at a central portion of wide-open portion 21a by a plurality of support arms 29. The lower end of support rod 24 is mounted on vent lid 22, and its upper end is pivotally supported on one end of arm 27. The other end of arm 27 is pivotally supported on the upper end of drive rod 26. The lower end of drive rod 26 is connected to drive cylinder 25 and is vertically moved by it. Support arm 30 projects upward from the upper periphery of wide-open portion 21a. An intermediate portion of coupling arm 27 is pivotally mounted on the upper end of support arm 30, and arm 27 swings about arm 30 as its pivot shaft. Drive cylinder 25 is controlled by cylinder control mechanism 31 connected to controller 17. Drive rod 26 is vertically moved by drive cylinder 25. As a result, arm 27 swings. Accordingly, vent lid support rod 24 is vertically moved, and vent lid 22 is opened/closed.

Figure 4:
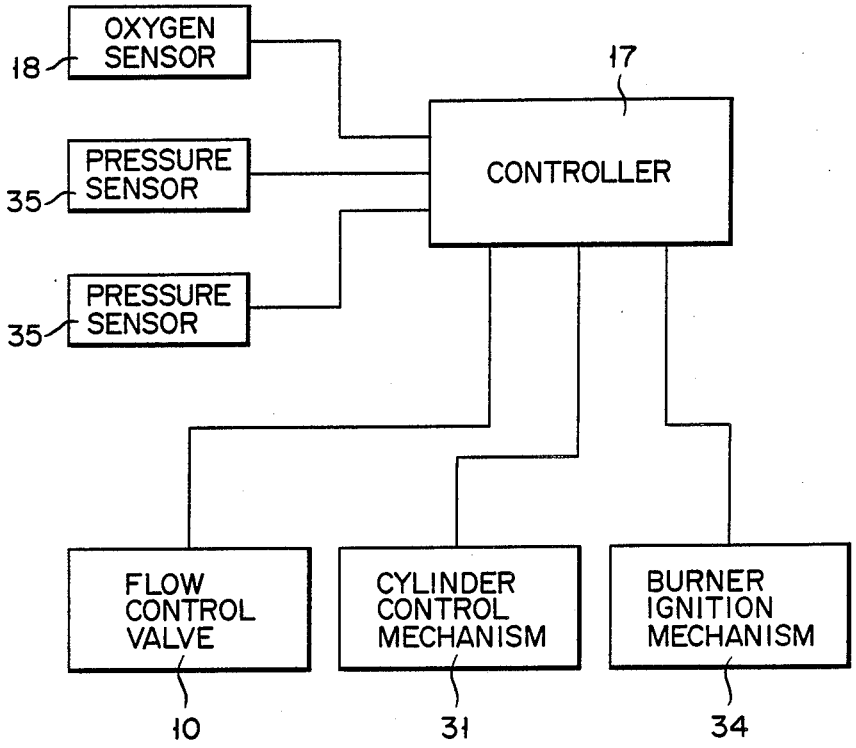
FIG. 4 is a block diagram showing the arrangement of a controller.

Ring burner 32 is concentrically provided above wide-open portion 21a . Burner 32 is coupled to a fuel supply pipe, as shown in FIG. 3. A fuel such as a hydrocarbon gas is supplied to burner 32 through fuel supply pipe 33. Burner ignition mechanism 34 as shown in FIG. 4 is provided in the vicinity of burner 32. A gas from burner 32 is ignited by mechanism 34. Mechanism 24 is connected to and controlled by controller 17.

Pressure sensors 35 are provided in load and hardening chambers 2 and 3, respectively. Sensors 35 are connected to controller 17. When the entrance door of load chamber 2 or the exit door of hardening chamber 3 is open, the high-temperature atmospheric gas in load or hardening chamber 2 or 3 flows out, and a pressure difference sometimes occurs between the chamber and the furnace main body, and a pressure in the chamber sometimes becomes negative. When the pressure in load or hardening chamber 2 or 3 becomes negative, pressure sensor 35 detects this pressure decrease and supplies a detection signal to controller 17. Based on the signal representing a pressure decrease, controller 17 starts burner ignition mechanism 34 and supplies a hydrocarbon gas to burner 32, thus igniting burner 32. Subsequently, cylinder control mechanism 31 is operated by controller 17, drive cylinder 25 is actuated by mechanism 31, and vent lid 22 is opened. When vent lid 22 is opened in this manner, a combustion gas generated by combustion of the gas of burner 32 is supplied to load or hardening chamber 2 or 3 that is at a negative pressure. As a result, the negative pressure in load or hardening chamber 2 or 3 is canceled.

The gas carburizing method of the present invention will be described together with the operation of the continuous gas carburizing furnace described above. First, the entrance door of load chamber 2 is opened, and a workpiece to be carburized is loaded in load chamber 2. Subsequently, the entrance door is closed, intermediate door 2a is opened thereafter, and the workpiece is further sent to furnace main body 1. The temperature in furnace main body 1 is maintained at about 900° to 930° C. which is a gas carburizing temperature. The hydrocarbon gas and air supplied to furnace main body 1 are mixed to react with each other, thereby generating an atmospheric gas having a carburizing property. The composition of the atmospheric gas is adjusted to contain 20 to 26% of carbon monoxide, 30 to 40% of hydrogen ($H_2$), 7% or less of methane ($CH_4$), and 38 to 45% of nitrogen ($N_2$). The workpiece supplied in furnace main body 1 is conveyed through first and second carburizing sections 7 and 8, diffusion section 9, and hardening chamber guide section 10 in the order named, and carburized by the atmospheric gas in furnace main body 1. The carburizing time is about 4 to 6 hours. The workpiece is further sent to hardening chamber 3 from furnace main body 1, dipped in oil tank 4 under hardening chamber 3, and hardened. The exit door of hardening chamber 3 is opened and the hardened workpiece is taken out.

During carburizing described above, the composition of the atmospheric gas in furnace main body 1 is adjusted in the following manner. First, the flow rate of the hydrocarbon gas to be supplied to furnace main body 1 is maintained at a constant value. The composition of the atmospheric gas is adjusted by adjusting the flow rate of only air to be supplied to furnace main body 1. More specifically, the oxygen concentration of the atmospheric gas in furnace main body 1 is detected by oxygen sensor 18, and an oxygen concentration signal is supplied to controller 17. Controller 17 adjusts the opening of flow rate control valve 16 of air supply pipe 13 based on the oxygen concentration, and thus adjusts the flow rate of the air to be supplied to furnace main body 1. The composition of the atmospheric gas in furnace main body 1 is adjusted by this air supply flow rate adjustment, and the carbon potential of the atmospheric gas is thus adjusted. With this adjusting method, the carbon potential of the atmospheric gas can be adjusted easily and rendered stable.

When the entrance door of load chamber 2 or exit door of hardening chamber 3 is opened to load or unload a workpiece during operation of the continuous gas carburizing furnace, the atmospheric gas in the chamber flows out, thus sometimes causing a negative pressure in it. In this case, the pressure decrease in load or hardening chamber 2 or 3 is detected by pressure sensor 35, and a detection signal is supplied to controller 17. Controller 17 sequentially operates burner ignition mechanism 34, burner 32, and cylinder control mechanism 31, ignites burner 32 and simultaneously opens vent lid 22. As a result, the combustion gas generated by burner 32 is supplied to load or hardening chamber 2 or 3 that is at a negative pressure through vent pipe 21, and the negative pressure in it is canceled. In this manner, the air flow into load or hardening chamber 2 or 3 is prevented.

The fuel gas supplied to burner 32 is the same gas (e.g., a propane or city gas) as the hydrocarbon gas supplied to furnace main body 1. Therefore, the combustion gas generated by burner 32 has substantially the same composition as that of the atmospheric gas in furnace main body 1. Even if this combustion gas is supplied to load or hardening chamber 2 or 3, the composition of the atmospheric gas in furnace main body 1 will not be changed. Since combustion units 5 are provided, a conversion furnace need not be provided separately from furnace main body 1, resulting in an economical advantage. The apparatus of the present invention does not need an expensive inert gas supply source, nor does the composition of the atmospheric gas need to be changed, unlike in an apparatus wherein an inert gas of a type different from the atmospheric gas is supplied.

The present invention is not limited to the above embodiment. It is apparent that various changes and modifications can be made within the spirit and scope of the invention by a person of ordinary skill in the art.

We claim:

1. A gas carburizing method for filling a furnace main body with an atmospheric gas having a carburizing property and carburizing a workpiece in said furnace main body in the absence of a separate furnace for generating a gaseous mixture adapted to adjust the carbon potential of the atmospheric gas, said process comprising:

supplying a hydrocarbon gas at a constant flow rate and air directly to said furnace main body to thereby obtain a mixture of said hydrocarbon gas and air, reacting said mixture in said main body furnace to thereby generate an atmospheric gas having a carburizing property; and adjusting the flow rate of air to said furnace main body to thereby adjust the carbon potential of said atmospheric gas.

2. The method according to claim 1, further comprising controlling the flow rate of air to thereby adjust the oxygen content of the atmospheric gas in said furnace main body.

3. A gas carburizing apparatus having a furnace main body adapted to be filled with an atmospheric gas having a carburizing property, a load chamber provided to an entrance side of said furnace main body, and an unload chamber provided to an exit side of said furnace main body, said apparatus comprising:

a plurality of combustion units communicating with said load and unload chambers, each of said combustion units comprising a vent pipe having one end portion communicating with said load or unload chamber and the other end open to the air, a vent lid for opening and closing a distal end portion of said vent pipe, and a burner for combusting the hydrocarbon gas, provided to the other end portion of said vent pipe;

hydrocarbon gas supply means for supplying hydrocarbon gas directly into said main body at a constant flow rate;

air supply means for supplying air directly into said main body; and control means for controlling the flow rate of air from the air supply means and thereby control the carbon potential of said atmospheric gas generated by the reaction of the hydrocarbon gas and air in said main body.

4. The apparatus according to claim 3, wherein said burner has a ring shape.

5. The apparatus according to claim 3, further comprising:

pressure sensor means provided in said load and unload chambers for detecting a decrease in pressure in said chambers; and combustion unit operating means for receiving a signal from said pressure sensor means and operating said combustion units when the pressure in said load or unload chamber is negative.

* * * * *